United States Patent [19]

Greenblatt

[11] Patent Number: 4,801,478

[45] Date of Patent: Jan. 31, 1989

[54] MUSICAL ORNAMENT FOR CELEBRATED OCCASIONS

[76] Inventor: Abraham Greenblatt, 6722 Waggoner Dr., Dallas, Tex. 75230

[21] Appl. No.: 48,979

[22] Filed: May 12, 1987

Related U.S. Application Data

[63] Continuation of Ser. No. 831,407, Feb. 20, 1986, abandoned.

[51] Int. Cl.[4] ..... G10F 1/06

[52] U.S. Cl. ..... 428/7; 84/94.2; 431/296

[58] Field of Search ..... 84/94.2; 428/3, 7; 431/289, 296; D17/24, 99; 369/31, 63; 360/12

[56] References Cited

U.S. PATENT DOCUMENTS

| | | | |
|---|---|---|---|
| D. 135,847 | 6/1943 | Ajello | 84/94.2 X |
| D. 177,993 | 6/1956 | Kranz | D11/129 X |
| D. 249,588 | 9/1978 | Tanikawa | D26/7 |
| 2,874,496 | 2/1959 | Rakes | 40/411 X |
| 3,236,389 | 2/1966 | Murdock | 428/7 X |
| 3,308,705 | 3/1967 | Shinnick | D17/24 X |
| 3,349,661 | 10/1967 | Searls | D17/24 X |
| 3,803,579 | 4/1974 | Compton | 340/526 X |
| 3,994,502 | 11/1976 | Lombardi | 428/3 X |
| 4,416,075 | 11/1983 | Bauer | 428/7 X |
| 4,477,249 | 10/1984 | Ruzek et al. | 431/289 X |
| 4,504,701 | 3/1985 | Lucchesi | 379/375 |
| 4,525,821 | 6/1985 | Garcia | 428/3 X |
| 4,531,319 | 7/1985 | Saxton | 428/7 X |
| 4,568,269 | 2/1986 | Lin | 431/289 X |
| 4,568,303 | 2/1986 | Brown | 446/242 |
| 4,595,905 | 6/1986 | May | 340/309.5 X |
| 4,652,980 | 3/1987 | Segan | 84/94.2 X |
| 4,678,093 | 7/1987 | Allen | 215/100 R X |
| 4,704,934 | 11/1987 | Nosrati | 84/94.2 X |

*Primary Examiner*—Henry F. Epstein

*Attorney, Agent, or Firm*—Hubbard, Thurman, Turner & Tucker

[57] ABSTRACT

A decorative notion or ornament for special occasions of purposes providing both an identifiable theme and melody associated with an occasion to be celebrated or purpose to be noted. Comprising the ornament is a figurine or other identifiable theme constructed with a simulated appearance (if appropriate) long associated with a special purpose occasion or purpose. Assembled plastic sections are interfitted to form an enclosure defining an internal cavity in which a battery operated melody module is contained. The melody module includes a microchip that has been preprogrammed to play a selected melody normally associated with the identifiable theme while a suitable switch is available to actuate, prolong or discontinue playing of the melody.

8 Claims, 2 Drawing Sheets

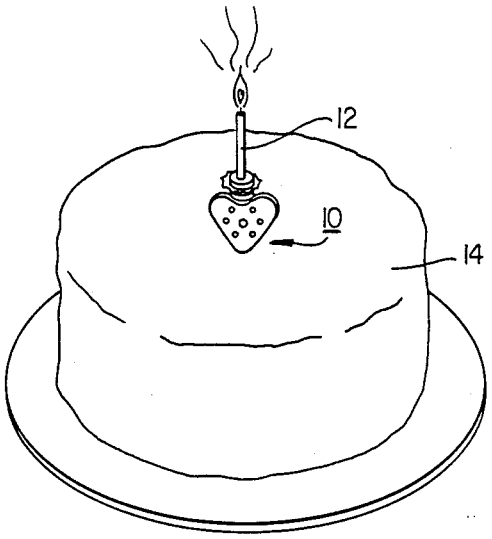
FIG. 1
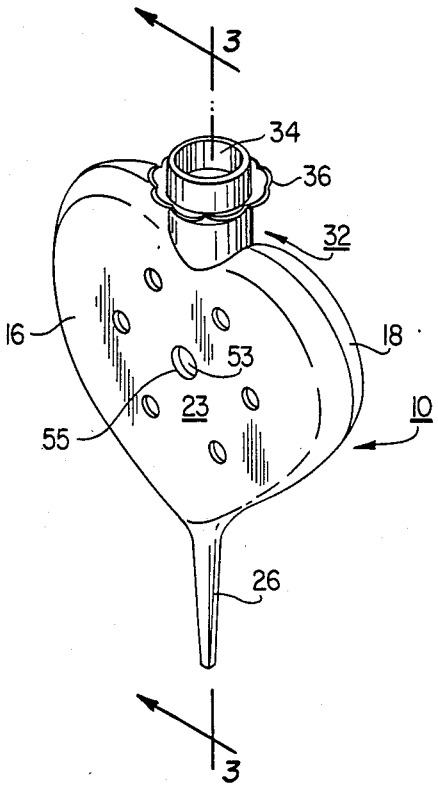
FIG. 2
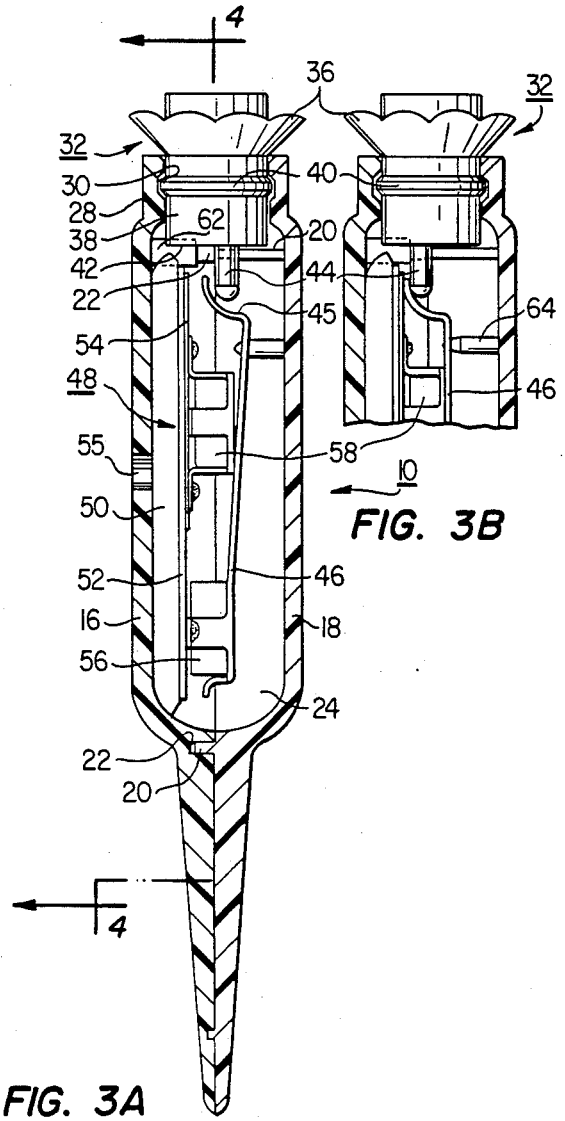
FIG. 3A
FIG. 3B

MUSICAL ORNAMENT FOR CELEBRATED OCCASIONS

This application is a continuation of application Ser. No. 831,407, filed Feb. 20, 1986, now abandoned.

TECHNICAL FIELD

The technical field to which the invention pertains comprises the art of notions and ornaments for special purpose occasions.

BACKGROUND OF THE INVENTION

Decorative notions and ornaments for special purpose occasions have been used since time immemorial in order to add a heightened emotional emphasis to the festivities or occasions being celebrated. Typical items for those purposes have been symbolic figurines or ornaments of sorts placed on a cake, flower bouquet, candy box, etc., that is readily associated with the occasion to be celebrated. For a wedding, for example, a figurine of a formally attired bride and groom might be supported on a stick pin which can be inserted conspicuously onto the top surface of a wedding cake for all to see. Other such ornaments may be mounted or attached to whatever recipient device with which they are to be associated.

The foregoing type items are widely marketed and specially adapted for the many official and unofficial occasions for which our society and culture tend to and have become accustomed to celebrate. Whether it is Valentine's Day, birthday, anniversary, Father's Day, Mother's Day, graduation or whatever, appropriate decorative items are available for association with the occasion. Typically, such items are constructed of wood, plastic or metal and are limited in their functions by the physical appearance which they simulate or suggest.

SUMMARY OF THE INVENTION

The invention relates to decorative notions and ornaments for special purpose occasions. More specifically, the invention hereof relates to such decorative notions and ornaments which not only provide a recognized theme for the occasion with which it is to be associated, but at the same time provides a melody likewise associated with the occasion being celebrated. Typical melodies would be "Happy Birthday" and "Here Comes the Bride", etc., for birthdays and weddings respectively, thereby to further heighten the interest and emotion of those invited guests participating in the celebration.

The foregoing is achieved in accordance with the invention by means of a figurine or other suitable ornament constructed with an appearance or other identified theme long associated with such specific purpose or occasion. Rather than being of solid composition or permanently enclosed from the onset of its manufacture, the figurines or ornaments hereof are assembled of separate interfitting sections so as to define an enclosure having an internal cavity in which a battery operated melody module is secured. The melody module includes a microchip that has been programmed to emit a selected melody while a suitable switch is available to actuate, prolong or discontinue playing of the melody that has been programmed therein. The emotional advantage afforded by the melody under such circumstances should be instantly apparent.

It is therefore an object of the invention to provide a novel decorative notion or ornament for the celebration of special occasions.

It is a further object of the invention to effect the foregoing object in which the notion or ornament provides a combination of both an identifiable theme and melody normally associated with the occasion to be celebrated or purpose to be noted.

Those skilled in the art will recognize the above mentioned features and advantages of the present invention as well as additional superior aspects thereof upon reading the detailed description in conjunction with the drawings.

BRIEF DESCRIPTION OF THE DRAWINGS

FIG. 1 is a pictorial view of a birthday cake on which has been placed a candle holder in accordance with the invention;

FIG. 2 is an enlarged isometric view of the candleholder of FIG. 1;

FIG. 3A is a sectional view as seen substantially from the position 3—3 of FIG. 2 for the "off" relation of the melody module;

FIG. 3B is a fragmentary view corresponding to FIG. 3A for the "on" position of the melody module;

DESCRIPTION OF THE PREFERRED EMBODIMENTS

Figure 4:
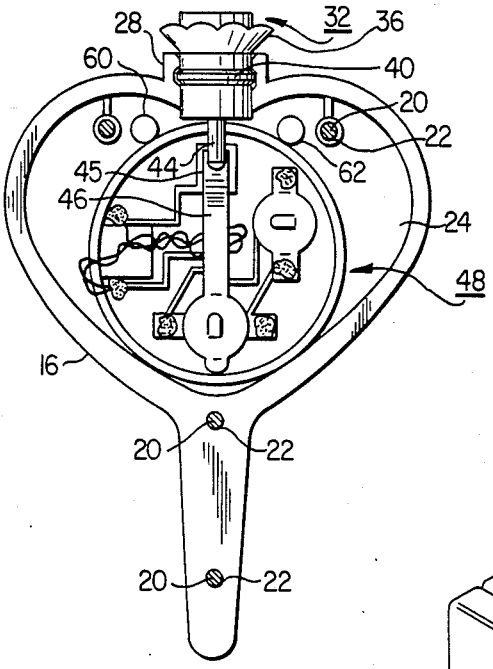
FIG. 4 is a sectional elevation as seen substantially from the position 4—4 of FIG. 3A.

In the description which follows, like components are marked throughout the specification and drawing with the same reference numerals, respectively. Drawing figures are not necessarily to scale and certain features may be shown exaggerated in scale or in somewhat schematic form in the interest of clarity and conciseness.

Referring first to FIG. 1, there is disclosed a first embodiment of the invention in which the ornament hereof designated 10 is in the form of heart-shaped candleholder to support a candle 12 and adapted for insertion in a cake or the like 14.

Comprising candleholder 10 as will be described with reference to FIGS. 2–4 are two opposite and complementary shell sections 16 and 18 molded of a polymer plastic composition. The shells are adapted to be interfitted together by means of a plurality of vertically spaced integral pins 20 on shell 18 and integral boss recesses 22 on shell 16 cooperatively matched in size and location to afford an interference fit therebetween.

The central portion of this embodiment comprises a heartlike enclosure 23 defining a centrally located internal cavity 24. The lower portions at the underside of enclosure 23 are joined to define an elongated tapered shank 26 able to function as a stickpin or the like for insertion of the candle holder into a soft surface such cake 14. At its upper end, the opposing shells define a tubular neck 28 that includes an annular recess 30 in which to support a candle receptacle 32 for rotation.

Candle receptacle 32 includes at its distal end a central inward bore 34 of size in which to receive and support a candle 12 (FIG. 1) and is surrounded by a scalloped fringe or frill 36 functioning for both decorative purposes and finger gripping for rotation as will be understood. Beneath the fringe 36, the receptacle 32 includes a cylindrical shank 38 on which is contained an annular bead or rib 40 for positioned containment within recess 30 in order to enable rotation of the receptacle. Downwardly depending from the underside of face 42 of the shank 38 and concentrically offset with respect to the axis of rotation thereof is an elongated pin actuator 44 adapted when the receptacle 32 is rotated to engage the backside of a shoe contact 45. The shoe represents the electrical contact end of elongated switch contact 46 of a melody module 48 as will be described.

Melody module 48 (see FIGS. 3 and 4) is of a type commercially available from various domestic and foreign sources and is generally comprised of a plastic base 50 on which is supported a ceramic substrate 52 and a metal diaphragm 53 facing aperture 55. The substrate contains a printed circuit 54 and a microchip (not shown) operative when actuated to emit a melody for which it has been preprogrammed. Two 1.5 volt batteries 56 and 58 provide the electrical energy for enabling the sound output to be emitted through a plurality of apertures 55 in shell 16 when shoe 45 of elongated switch arm 46 momentarily engages contact 54.

For retaining melody module 48 secured in place within cavity 24, there are provided two transversely spaced integrally molded pins 60 and 62 (FIG. 4) which, in cooperation with the lower cavity wall define a nest for receipt and securement of the melody module 48 thereat. Integral pointed protrusions 64 extending laterally inward of the cavity from shell 18 to enhance the retention and nesting thereof. In operation of the embodiment of FIGS. 1–4, with or without a candle contained within bore 34 of receptacle 32, the receptacle is completely rotatable within neck recess 30. In the course of rotation, downwardly depending pin 44 incurs a predefined circular path of motion that includes engagement against switch shoe 45. As can be appreciated by comparing FIGS. 3A and 3B, the contact shoe 45 is normally located spaced apart from printed circuit contact 54. As pin 44 engages the backside of shoe 45, the shoe is forced into engagement against contact 54 so as to initiate playing of the melody which has been preprogrammed on the module 48. A passing engagement will effect one playing of the melody while continuous contact will cause continuous playing of the melody. For this embodiment, which is most frequently utilized for occasions of a birthday celebration, the module is preferably programmed to play "Happy Birthday". For a Valentine's Day celebration, the module might typically be programmed to play "A Sweetheart of Mine" or any other appropriate or identifiable tune. Whatever tune is played, its melody is emitted from the module through a plurality of apertures 55 in shell 16 extending in general communication with the diaphragm 53 in order to render the melody audible within a proximate distance thereabout.

Figure 5:
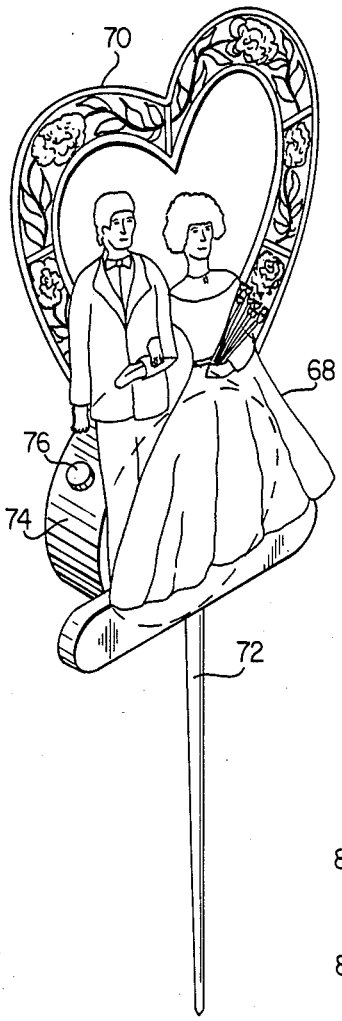
FIG. 5 is an isometric view of a bride and groom ornament in accordance with the invention.

As disclosed in FIG. 5, a bride and groom figurine 68 is utilized surrounded by a heart 70 and supported on a stickpin 72 for insertion into a cake or flowers as might be appropriate for the occasion of a wedding celebration. Secured to the backside of the figurine is a cylindrical capsule enclosure 74 formed generally as above. Unlike candleholder 10 which utilizes the candle receptacle as a switch for actuating the module 48, there is provided in this embodiment a push button 76 to actuate playing of the melody preprogrammed into the module 48 therein. For this theme, the module would normally be programmed for "Here Comes the Bride" or some other selected melody appropriately associated with the occasion.

Figure 6:
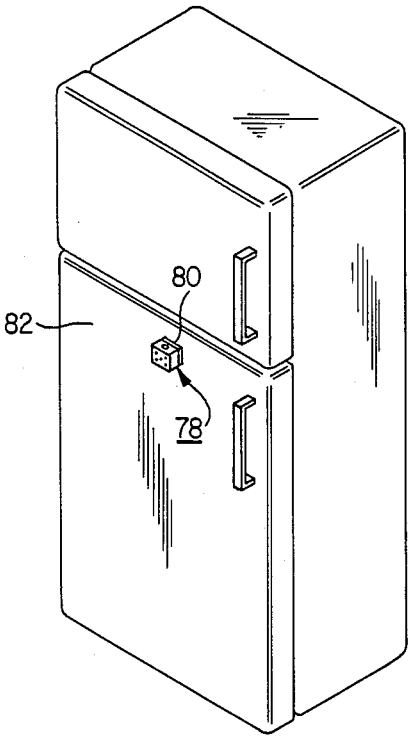
FIG. 6 is an isometric view of a refrigerator mounted ornament in accordance with the invention.
Figure 7:
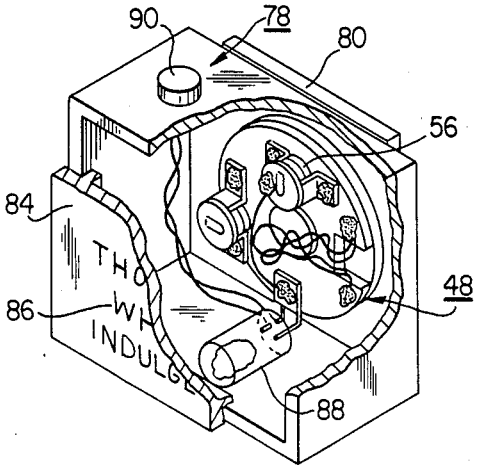
FIG. 7 is an enlarged partially cutaway isometric view of the ornament of FIG. 6.

In the embodiment of FIGS. 6 and 7, the enclosure 78 is formed as a rectangular box, the backside of which contains a magnetic holder 80 for mounting on the door of a refrigerator 82. The front side 84 of box 78 carries a slogan 86 such as "Those who Indulge—Bulge" and the melody to be played by module 48 might for example be "You're Too Fat For Me". Unlike the previous embodiments in which a manually actuated switch serves to engage the shoe 45 of a switch arm 46, the embodiment hereof utilizes a mercury switch 88 to actuate the melody module in response to movement or opening of the refrigerator door. A switch 90 on the exterior of enclosure 78 functions to inactivate the module when desired or when repetitious hearing of the melody become emotionally painful.

By the above description there is disclosed novel decorative notins and ornaments for special occasions or purposes that serve not only to identify with the occasion or purpose but also includes a melody culturally selected to be identifiably associated therewith. The ornament by simulated appearance per se, by slogan or by attachment includes an enclosure provided with an identifiable theme associated with the exterior thereof. At the same time, a battery operated melody module secured within a cavity of the enclosure is preprogrammed when actuated to emit a melody sound associated with the theme identified by the enclosure. Such items can be conveniently marketed as notion or novelty type items at relatively low cost and serve a unique function by heightening the emotion in pursuit of the purpose or in the celebration of the occasion. For whatever purpose the ornament is to be utilized, it is readily adapted to an appropriate format along the foregoing lines with a melody module selected to match. Consequently, by means of the invention hereof there is afforded a novel product advantageously useful in the celebration of special occasions or purposes.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. An ornament comprising in combination:

(a) means forming an assembled enclosure defining an interior cavity and having an identifiable theme associated with the exterior thereof;

(b) an electrically operated melody module secured in the cavity of said enclosure, said module being preprogrammed when actuated to emit a melody sound socially selected to associate with the identifiable theme of said enclosure; and (c) switch means for actuating said module to emit the selected melody sound to the proximate vicinity about the location of said enclosure, (d) said enclosure comprising a candleholder assembled of opposing sections, an elongated generally tapered shank extending from the underside of said enclosure, a tubular neck extending from the topside of said enclosure, a candle receptacle supported for rotation within said neck and extending to a distal end outward of said neck; and said switch means comprises means secured to said receptacle to inward of said cavity for actuating said module in the course of said receptacle being rotated on its support.

2. The ornament according to claim 1 in which the identifiable theme is represented by a slogan contained on the exterior of said enclosure.

3. The ornament according to claim 1 wherein the identifiable theme is represented at least partially by the configuration of said enclosure.

4. The ornament according to claim 1 wherein the identifiable theme is represented by a figurine secured to said enclosure.

5. The ornament according to claim 1 wherein said enclosure is comprised of opposing sections, said opposing sections have complementary interlocking elements on the respective sections for effecting a secure interlock therebetween defining said enclosure, and there is included means to mount the ornament onto a recipient support for which the ornament is intended.

6. An ornament according to claim 1 in which said switch means comprises a protrusion depending downwardly from the underside of said receptacle at a location offset from the axis of said receptacle and terminating at its distal end at a location adapted to actuate said module contact in the course of said receptacle being rotated.

7. An ornament according to claim 1 in which said enclosure is comprised of a molded polymer plastic composition.

8. The ornament according to claim 1 including a mercury switch connected electrically intervening between said switch means and said module contact to effect operation of said module in the course of said enclosure being displaced.

* * * * *